US006514179B1

(12) United States Patent
Yu

(10) Patent No.: US 6,514,179 B1
(45) Date of Patent: Feb. 4, 2003

(54) ROLLING BALL HAND-SHAKING EXERCISER

(76) Inventor: Hui-Nan Yu, 14, Lane 252, Chien Kuo Road, Taoyuan (TW)

( * ) Notice: Subject to any disclaimer, the term of this patent is extended or adjusted under 35 U.S.C. 154(b) by 0 days.

(21) Appl. No.: 10/045,088

(22) Filed: Jan. 15, 2002

(51) Int. Cl.[7] ..... A63B 5/00
(52) U.S. Cl. ..... 482/44; 482/110; 601/107
(58) Field of Search ..... 482/44, 45, 46, 482/49, 50, 148, 110; 472/137; 446/233; 601/107

(56) References Cited

U.S. PATENT DOCUMENTS 5,766,112 A * 6/1998 Chuan ..... 482/44
5,800,311 A * 9/1998 Chuang ..... 482/44
6,053,846 A * 4/2000 Lin ..... 482/44
6,241,637 B1 * 6/2001 Basyuk ..... 482/44

* cited by examiner

*Primary Examiner*—Stephen R. Crow
(74) *Attorney, Agent, or Firm*—Troxell Law Office PLLC

(57) ABSTRACT

A rolling ball hand-shaking exerciser comprises at least one main casing and one ball coated externally with soft material which rolls internally in the casing. The casing constitutes two identical semispherical shells interlocked integrally and extend outward to form tow handles. At the central beak of the shell a string of small pellets encircles one layer after layer with slightly projected head. When the player holds the handles and turns it around an orbit, the ball rolls in an inertia revolution manner with the limited space inside of the casing, it creates a vibration and damper action to achieve the hand exercise, and the pellets work as the massaging material as well.

1 Claim, 4 Drawing Sheets

ROLLING BALL HAND-SHAKING EXERCISER

FIELD OF THE INVENTION

This invention relates to a rolling ball hand-shaking exerciser in which a ball rolls in an inertia revolution in the inside of the casing.

BACKGROUND OF THE INVENTION

Presently the leisure activities are numerous and the sports materials that are available either in the gymnasium or in houses are very popular, are good for the public to promote healthcare in the leisure time. However, most sports materials are designed with complicated structure and bulky in volume, not easy for handling, requiring spacious storage room, not becoming available at the exact time when the player wants to play.

For this reason, based on the real requirement to keep availability of the sports materials all the time as the player wishes, the inventor has devoted great efforts for years to the professional research and development and eventually come up with this rolling ball hand-shaking exerciser.

SUMMARY OF THE INVENTION

The main object of the invention is to provide a roll ball hand-shaking exerciser with compact design, easy for handling and operation to let the player have the option to pick it up at any leisure time to practice hand exercises as he desires. The significant features and technology of this invention are expressed in great details with the aid of embodiments as illustrated in the drawings attached.

DETAILED DESCRIPTION OF THE INVENTION

Figure 1:
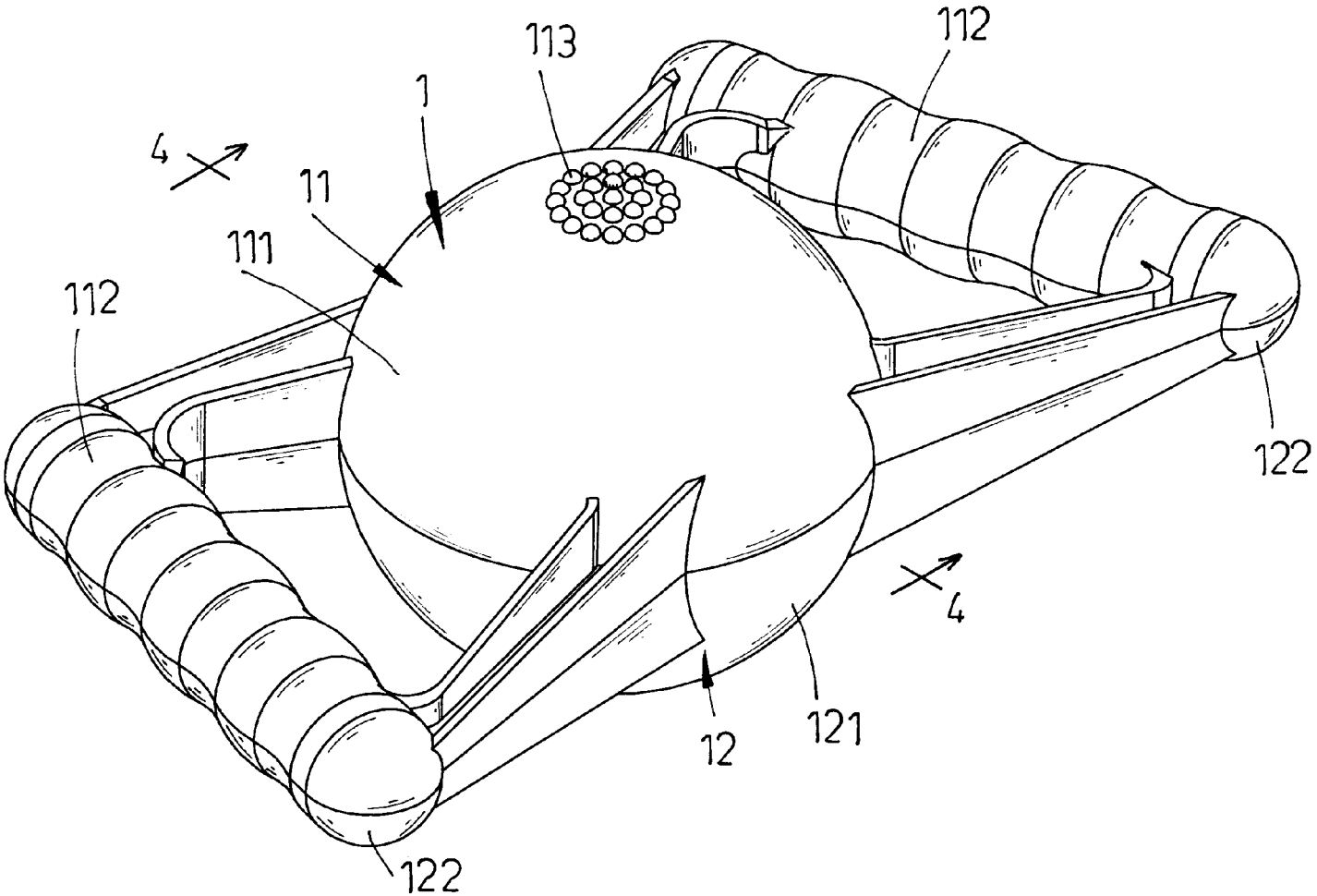
FIG. 1 is a stereo outlook of the hand-shaking exerciser of the invention.
Figure 2:
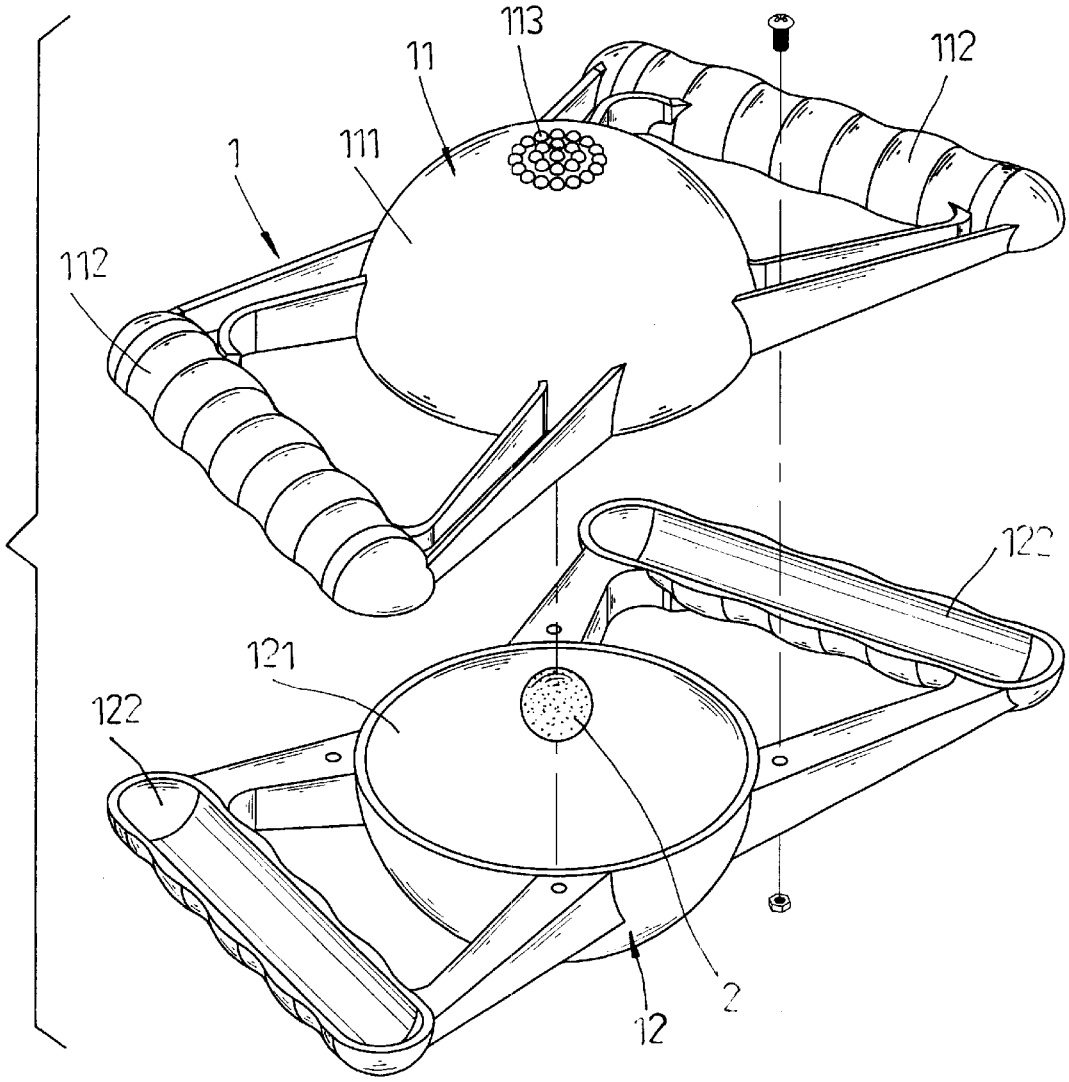
FIG. 2 is a disassembly of the hand-shaking exerciser of the invention.
Figure 3:
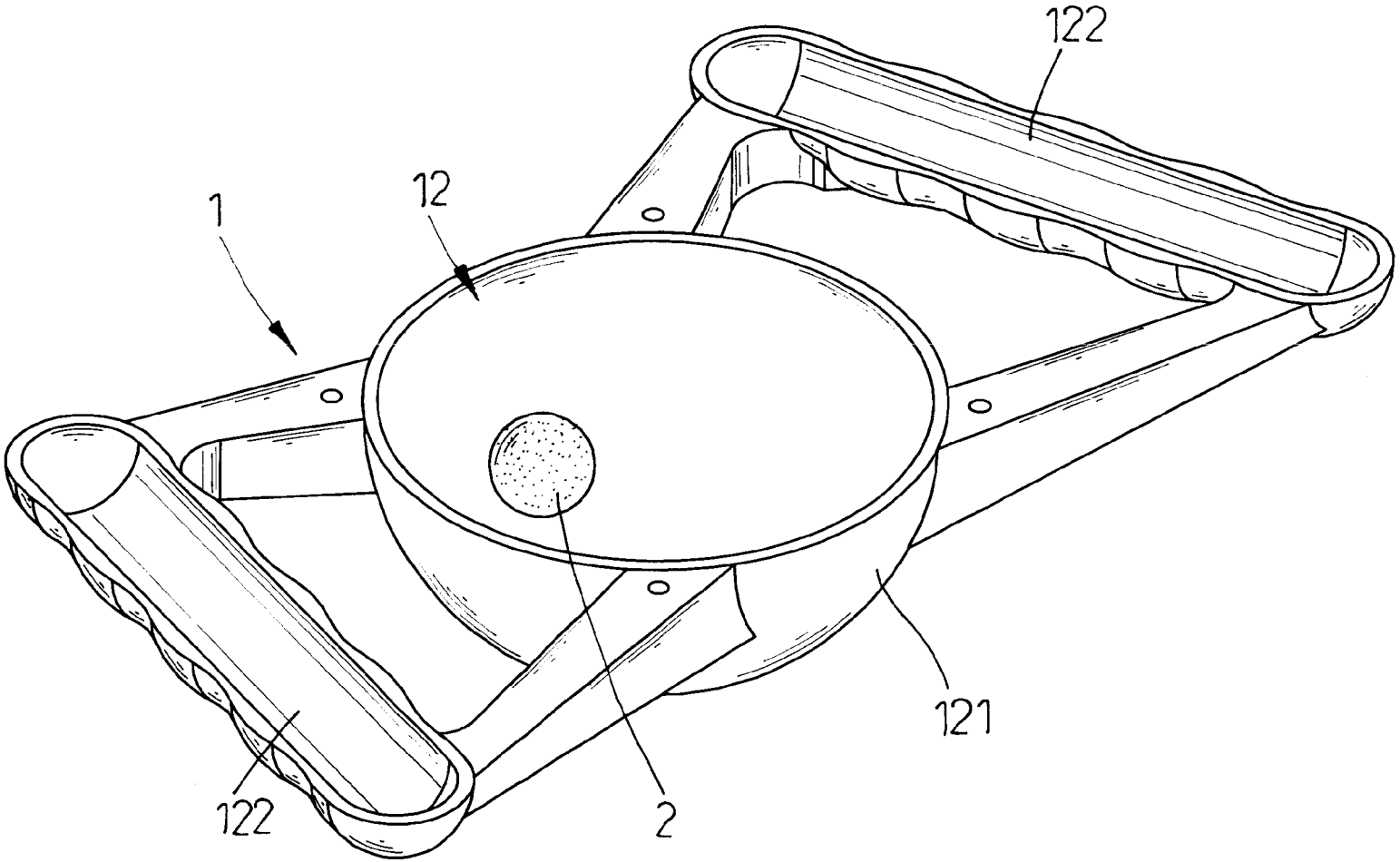
FIG. 3 shows a displacement routine of rolling ball along the rim as described in the invention.
Figure 4:
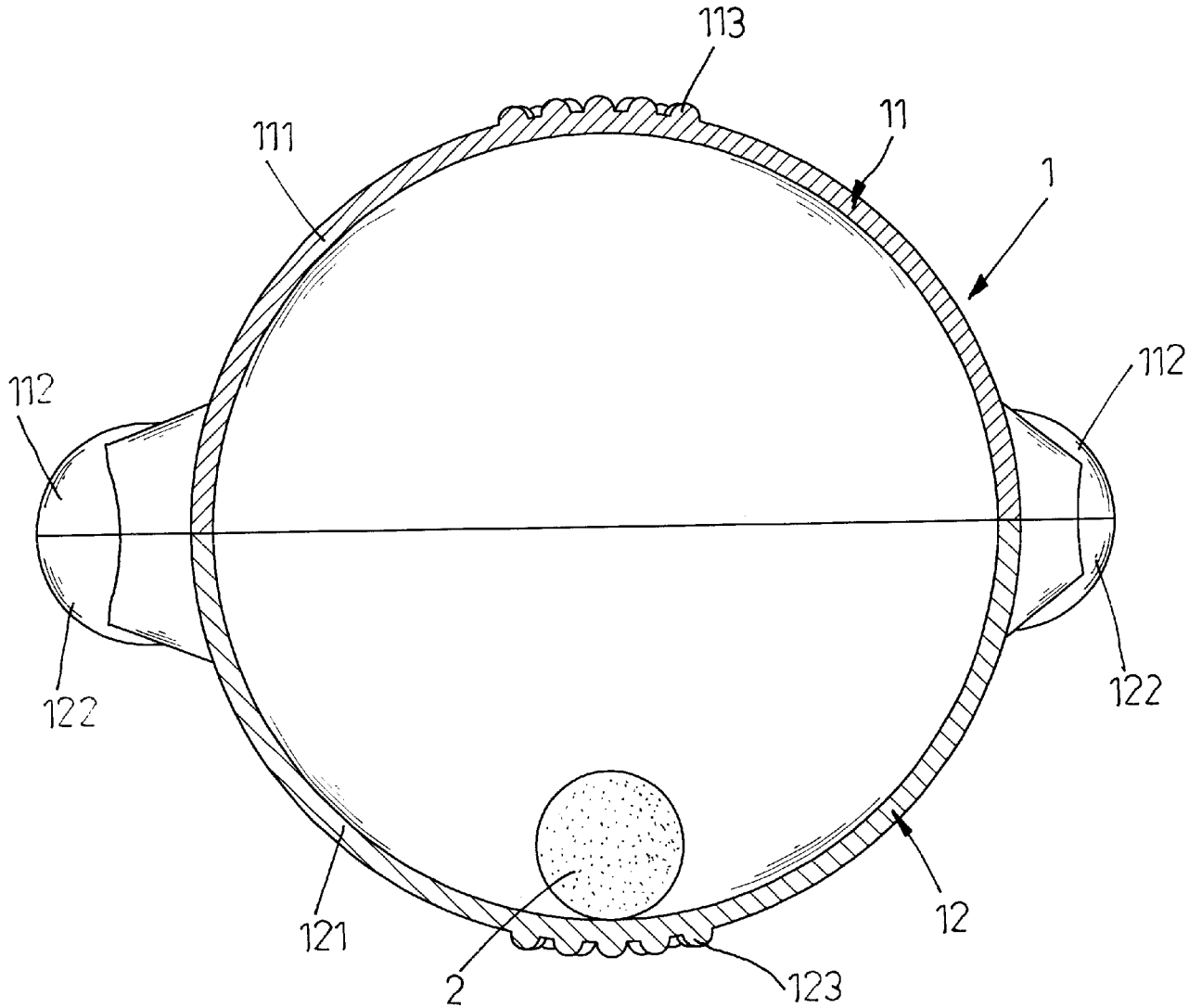
FIG. 4 shows an inertia revolution action of the rolling ball of the hand-shaking exerciser of the invention.

As shown in FIGS. 1 through 4, the roll ball hand-shaking exerciser contains a main casing 1 and rolling ball 2 externally coated with soft material. The main casing 1 is of two identical pieces of semispherical shells 11 and 12 interlocked together. At the rims 111 and 121 of the semispherical shells 11 and 12, two butterfly type handles 112 and 122 are formed and two strings of pellets 113 and 123 encircle one layer after layer at the central beak of the semispherical shells 11 and 12.

In practical operation, the player holds two handles 112 and 122 on the main casing 1 and shakes it around an orbit, so the rolling ball moves around the routine the rims 111 and 112 form; in the meantime, the ball revolves in inertia manner. These rolling and revolution produce vibration and damper effect on the hands. In addition, the strings of pellets 113 and 123 mounted at the central beak of semispherical shells 11 and 12 can be employed as effective massaging devices.

The rolling ball hand-shaking exerciser as described above is a novel design which achieves the pre-determined efficiency of physical exercise with good practicability.

Many changes and modifications in the above disclosed embodiment of the invention can, of course, be carried out without departing from the scope thereof. Accordingly, to promote the progress in science and the useful arts, the invention is disclosed and is intended to be limited only by the scope of the appended claims.

What is claimed is:

1. A rolling ball hand-shaking exerciser comprising: a casing and a rolling ball externally coated with a soft material and located in an inside of said casing wherein:

said casing includes two identical semispherical shells interlocked together, rims of the two semispherical shells extending outwardly to form two handles; and two strings of projecting pellets are formed at central portions of said semispheric shells, such that, when a player holds the two handles and moves the exerciser a round orbit, said ball rolls around an inside of the casing, producing a vibration effect transferred to hands of the user, and the strings of pellets work as massaging device.

* * * * *